US005114064A

United States Patent [19]

Jochum et al.

[11] Patent Number: 5,114,064

[45] Date of Patent: May 19, 1992

[54] POWDER CHARGE OPERATED SETTING TOOL

[75] Inventors: Peter Jochum, Meiningen, Austria; Martin Müller, Sax, Switzerland

[73] Assignee: Hilti Aktiengesellschaft, Fürstentum, Liechtenstein

[21] Appl. No.: 731,501

[22] Filed: Jul. 17, 1991

[30] Foreign Application Priority Data

Jul. 17, 1990 [DE] Fed. Rep. of Germany ..... 4022673

[51] Int. Cl.[5] ..... B25C 1/14

[52] U.S. Cl. ..... 227/9; 227/10

[58] Field of Search ..... 227/8, 9, 10, 11

[56] References Cited

U.S. PATENT DOCUMENTS 3,047,873 8/1962 Schulz ..... 227/9
4,374,567 2/1983 Combette et al. ..... 227/9
4,493,376 1/1985 Kopf ..... 227/9
4,655,380 4/1987 Haytayan ..... 227/9
4,821,938 4/1989 Haytayan ..... 227/10
4,945,730 8/1990 Laney ..... 227/10

*Primary Examiner*—Frank T. Yost
*Assistant Examiner*—Scott A. Smith
*Attorney, Agent, or Firm*—Toren, McGeady & Associates

[57] ABSTRACT

A powder charge operated setting tool includes a barrel (5) and a closing or breech member (8), both axially displaceable in a housing (1). Tensioning of a tension spring (18) for a firing pin (17) is made possible by means of a disengageable snap-in element (12) acting between housing (1) and closing member (8) by pressing the barrel (5) against the receiving material. The disengagement of the snap-in element (12) occurs only by overcoming a predetermined force acting counter to the setting direction which is generated by the gas pressure after a propellant charge (19) has been ignited.

6 Claims, 2 Drawing Sheets

POWDER CHARGE OPERATED SETTING TOOL

BACKGROUND OF THE INVENTION

The invention deals with an explosive powder charge operated setting tool having a housing with an axially displaceable barrel and closing or breech member. The barrel comprises a receptacle for a propellant charge, and the closing member contains a firing pin supported at the housing by a spring element acting in setting direction.

To reduce the recoil forces which have a deleterious effect on material stresses and the operating person, a powder charge operated setting tool is known from DE-PS 16 03 843, where a barrel and a closing member are displaceably located in a housing. Due to the displaceable arrangement of the barrel and closing member in the housing the reduction of the recoil forces is achieved but only with acceptance of other disadvantages. These other disadvantages are primarily seen in the design structure, since it is no longer possible to cock the firing pin supported in the closing or breech member in the conventional and service proved manner, pressing the setting tool against the soil. This entails that in the known solution a hammer acting upon the firing pin is arranged along an axis different from that of the firing pin, which requires the provision of a redirection or reversing lever between hammer and firing pin.

Because of these disadvantages, the solution in DE-PS 16 03 843 has not found wide acceptance, though it is advantageous avoidance of recoil forces and, in addition, provides the possibility of utilizing the displacement of the closing member initiated by the generated gas pressure for other functions, for instance, for feeding the propellant charges.

SUMMARY OF THE INVENTION

Therefore, the primary object of the present invention is to create a powder charge operated setting tool of the above mentioned type comprising a construction reducing the recoil forces and enabling a simple cocking of the firing pin in the conventional manner.

In accordance with the present invention a snap-in or detent element is provided between housing and closing or breech member permitting the displacement of the closing member counter to the setting direction and being disengageable by a predetermined force acting counter to the setting direction while overcoming such force produced by gas pressure generated after the propellant charge has been fired.

By abutment at the housing in the engaged position the snap-in element prevents a displacement of the closing member during the displacement of the barrel achieved by pressing its muzzle portion against the receiving material, so that a cocking spring abutting the closing member cocks the firing pin due to the pressing of the muzzle against the soil. The spring element acting in the setting direction upon the closing member can be dimensioned to be small as far as stresses are concerned because it merely has the function of displacing the closing member into the initial position into the setting direction.

The force generated by the gas pressure and causing the disengagement of the snap-in element can be considerably larger than the cocking force of the cocking spring. After the snap-in element has disengaged the barrel and the closing or breech member are displaced together by the gas pressure counter to the setting direction. After the setting or driving process has been completed, the spring element drives the closing member in a setting direction whereupon the snap-in element engages.

The snap-in element can expediently be arranged at the closing or breech member. This permits a placement within the housing protected from mechanical damage. A stop shoulder for the snap-in element is expediently provided at the housing facing in setting direction. The stop shoulder can be formed by the boundary wall of a recess or of a penetration in the housing.

Preferably, the snap-in element can be configured as a single arm rocking lever. One end of the rocking lever can serve as a rotary bearing supported at the closing member, while the other end carries a detent lug entering into contact with the stop shoulder at the housing. The closing member can comprise a recess essentially containing the rocking lever, wherein the recess is advantageously dimensioned in such a way that the rocking lever can plunge into same for disengagement.

The disengagement of the rocking lever occurs advantageously by providing the rocking lever with a control curve serving for disengagement and cooperates with a control cam. The control cam can sit at the closing member and, after the ignition process, moves with the consequently generated gas pressure together with the closing member counter to the setting direction. The rocking lever which cannot be displaced towards the rear because of abutment against the stop shoulder at the housing, is disengaged by the control cam by means of the control curve after it has covered a specific displacement travel and is carried along by the closing member which continues to travel counter to the setting direction.

The disengagement of the snap-in element occurs expediently counter to the force of a return spring, in order to assure the detent or snap-in connection between housing and closing member. For instance, a spring washer packet is suitable as a return spring; on the one hand it provides the force for the return of the snap-in element and on the other hand can serve as an elastic buffer for the closing member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
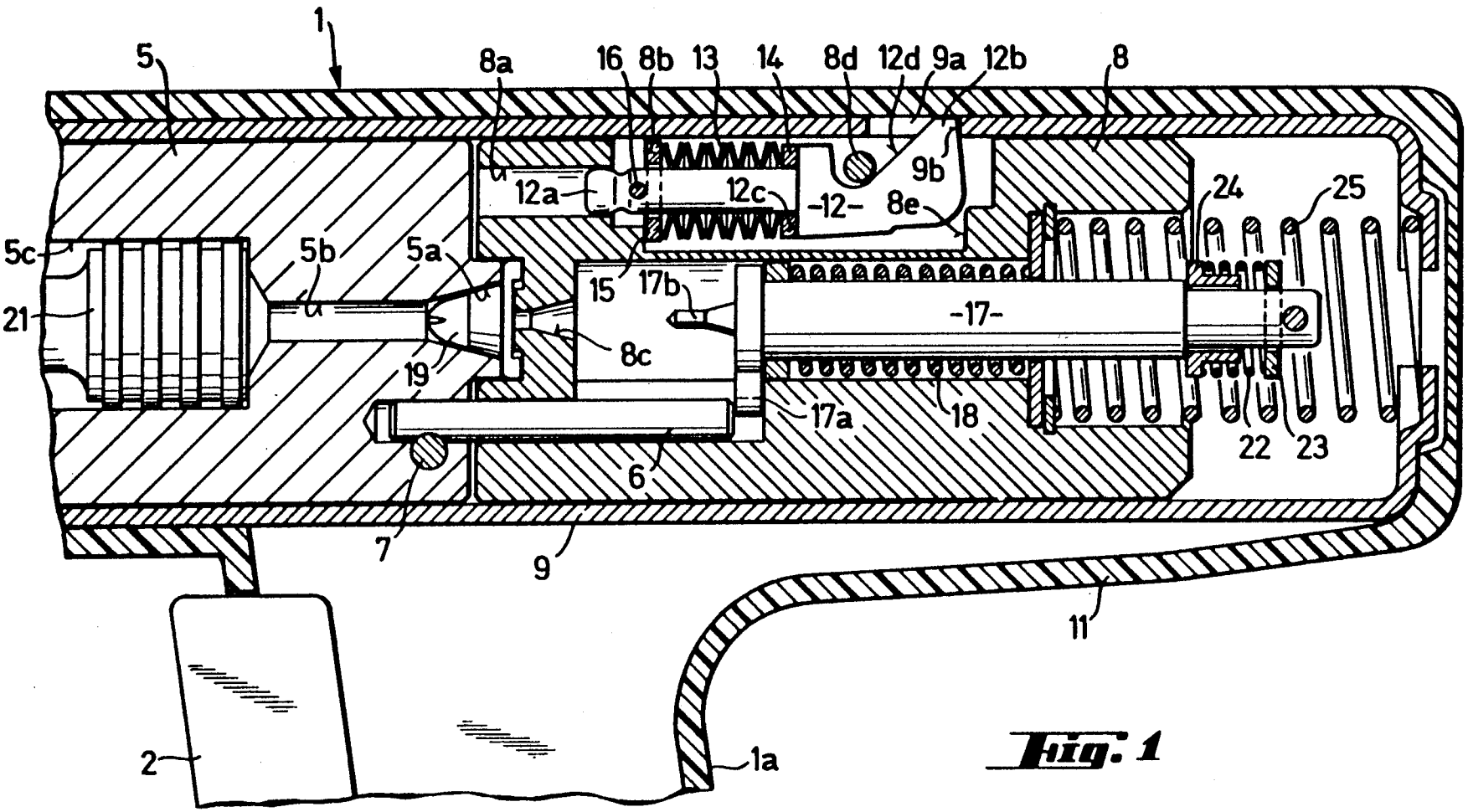
FIG. 1 is a sectional illustration of the rear region of a setting tool, in a position ready for firing or ignition.

The setting tool comprises a housing 1 with a handle 1*a* projecting from one side. A trigger 2 for initiating the firing process is arranged in the handle. A muzzle portion not shown here which can be pressed against the soil protrudes on the front in setting direction from the housing 1. When pressed against the receiving material, the muzzle portion displaces a barrel 5 in the housing 1 rearwardly into the position discernible from FIG. 1. An entrainment or driving bolt 6 projecting rearwardly from the barrel 5 is supported in the barrel 5 and is retained nondisplaceably by a crosspin 7.

A closing or breech member 8 is displaceably supported in the housing 1 behind the barrel in an essentially tubularly shaped guide member 9. The guide member 9 is mounted in a plastic shell 11 of the housing 1. A snap-in or detent element 12 in the form of a single arm rocking lever is supported in the closing or breech member 8. The detent element 12 has a front end **12*a* protruding into a bearing bore 8*a* in the closing member 8. The other end of the detent element 12 comprises a sideways projecting detent lug 12*b*, in a position ready for firing (FIG. 1), engaged into a window-like recess 9*a* of the housing 1 or of the guide member 9 and abutting in the rearward direction against a stop shoulder 9*b* formed by the recess 9*a*. A return spring 13 consisting of stacked spring washers holds the snap-in element 12 in the engaged position. For this purpose return spring 13 abuts towards the rear by means of disks 14, 15 against a shoulder 12*c* of the detent 11, 12 and towards the front against the shoulder 8*b* of the closing member 8. The return spring 13 is installed on the detent element 12 in a prestressed condition, and a stop pin 16 is provided at the detent member 12 as a support bearing for the disk 15**, for maintaining the prestress.

Furthermore, firing pin 17 extending axially in the setting direction is supported displaceably in the closing member 8. This firing pin comprises at its front a transversely projecting entrainment cam **17*a*. The entrainment cam 17*a* protrudes into the axial extension of the entrainment bolt 6 projecting into the closing member 8. When the barrel 5 is displaced towards the rear the entrainment bolt 6 carries along the firing pin 17 with engagement at the entrainment cam 17*a* counter to the force of a tension spring 18 abutted at the rear side in the closing member 8, into the illustrated position (FIG. 1) ready for firing. The engaged detent element 12, abutting against the stop shoulder 9*b*, prevents further displacement of the closing member 8** in the rearward direction.

The firing pin 17 comprises a firing tip **17*b* protruding forwardly for igniting a propellant charge 9 located in a chamber 5*a* in the barrel 5. This firing tip 10 can advance towards the propellant charge 19 while penetrating a sole through-aperture 8*c* in the closing or breech member 8. The chamber 5*a* is connected by a channel 5*b* with the barrel bore 5*c*, in which a driving piston 21 is displaceably supported in a known manner. A pull-back or return spring 22 sits at the rear of the firing pin 17, the spring abuts rearwardly by means of a disk 23 and towards the front by means of an abutment ring 24 against the firing pin 17**.

The closing member 8 is acted upon in the forward or setting direction by a spring 25 bearing against the housing 1 or the guide member 9. The tension of the spring element 25 is not affected by the displacement of the firing pin 17 into the position ready for firing, since the tension forces are abutted by the closing member 8 by means of the detent element 12 engaged at the housing 1. Thus, the spring element 25 can be dimensioned to be small as far as stresses are concerned, since it must merely fulfill the function of displacing the closing member 8 into the position seen in FIG. 1.

The initiation of the firing process occurs by actuation of the trigger 2 while the firing pin 17 is turned by means known as such and not depicted here, wherein due to this the entrainment cam **17*a* is displaced out of the effective range of the entrainment bolt 6. Subsequently, the firing pin 17 is driven by the stressed tension spring 18 against the propellant charge 19 which is ignited by the firing tip 17*b*. The firing pin 17 is then pulled back again to such an extent by the pull-back spring 22 that the firing pin 17*b* is spaced from the propeller charge 19**.

Figure 2:
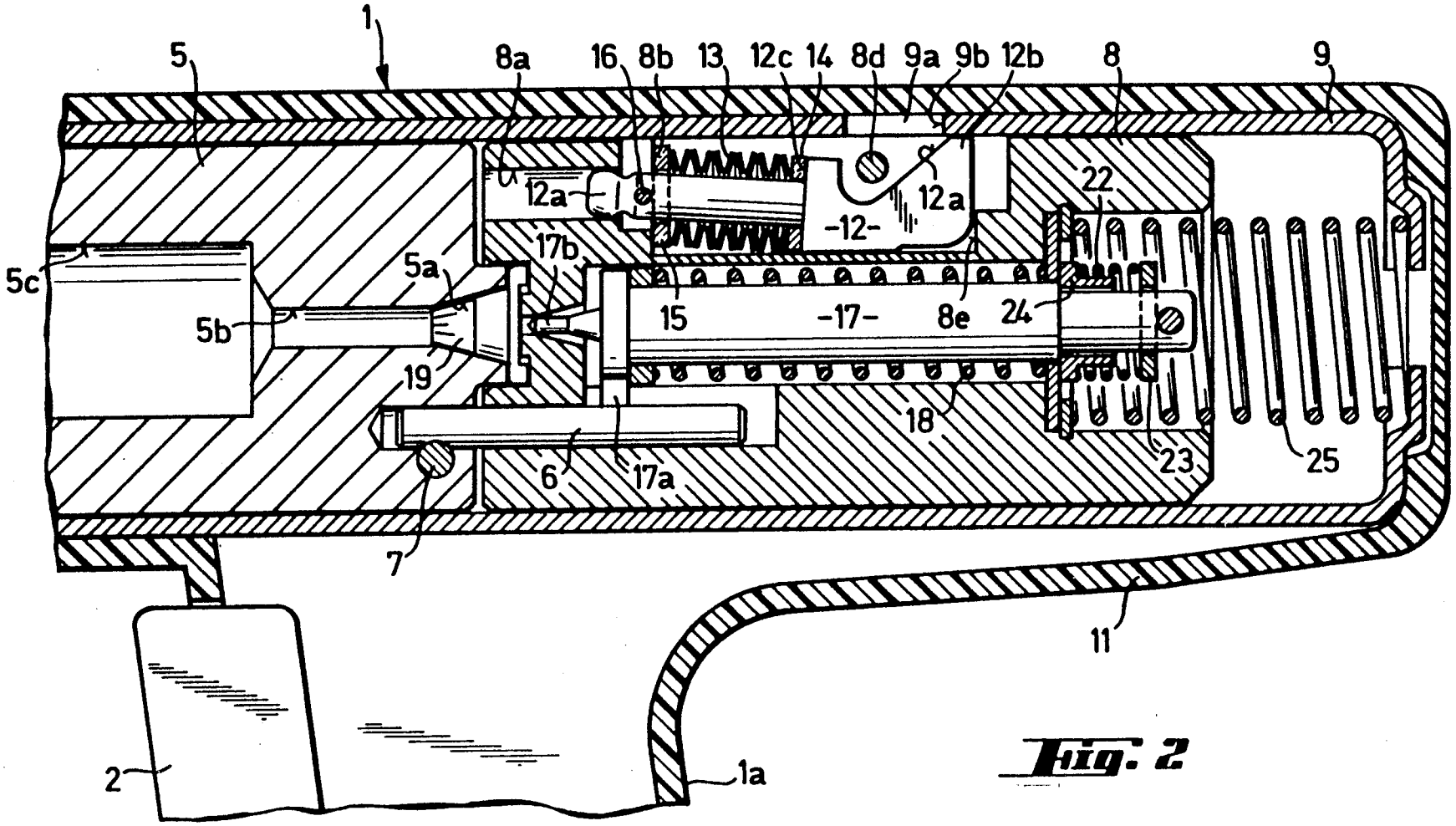
FIG. 2 is a sectional illustration of the rear region of a setting tool in FIG. 1 after ignition has occurred.

The gas pressure generated by the firing of the propellant charge 19 acts upon the driving piston 21. The driving piston is then accelerated in the barrel bore **5*c* for driving a fastening element in setting direction into the receiving material. However, the gas pressure also generates forces acting counter to the setting direction upon the barrel 5 and the closing member 8. These forces exceed the tension force of the return spring 13, so that there occurs a relative displacement of the closing member 8 against the snap-in element 12. This relative displacement results in a disengagement of the detent or snap-in element 12 out of the recess 9*a* due to the cooperation of a control cam 8*d* at the closing member 8 with a control curve 12*d* on the snap-in element 12. This occurs against the force of the return spring 13 with pivoting of the snap-in element 12 around the forward end 12*a* in the bearing bore 8*a* serving as an articulation or pivot point. Upon further displacement of the closing member 8 and the barrel 5 counter to the setting direction, the snap-in element 12 with the snap-in lug 12*b* slides along the inside contour of the guide member 9 as shown in FIG. 2. In this position the snap-in element 12 abuts counter to the setting direction at a back side 8*e* of the closing member 8. After the setting process is terminated the closing member 8 is again driven by the force of the spring element 25 into the position ready for firing or ignition shown in FIG. 1. With the snap-in element travelling with it, its snap-in lug 12*b* arrives again into the region of the recess 9*a* and is engaged by the return springs 13** by pivoting.

While specific embodiments of the invention have been shown and described in detail to illustrate the application of the inventive principles, it will be understood that the invention may be embodied otherwise without departing from such principles.

We claim:

1. Powder charge operated setting tool comprising a housing (1) having a setting direction, a barrel (5) and a closing member (8) axially displaceably located within the housing, the barrel (5) comprises a receptacle (**5*a*) for a propellant charge (19) and the closing member (8) contains a firing pin (17) and abuts the housing (1) through a spring element (25) acting in the setting direction, wherein the improvement comprises a snap-in element (12) within the housing and acting in a ready to fire position between the housing (1) and the closing member (8) and in engagement with the housing, said snap-in element arranged to overcome a predetermined force acting counter to the setting direction due to gas pressure generated after the propellant charge (19) has been ignited, which force disengages said snap-in element from the housing counter to the setting direction, and permits said snap-in element (12) to allow displacement of the closing member (8**) counter to the setting direction.

2. Setting tool according to claim 1, wherein the snap-in element (12) is supported on the closing member (8).

3. Setting tool according to claim 2, wherein a stop shoulder (9*b*) for the snap-in element (12) in the ready to fire position faces in setting direction is formed at the housing (1).

4. Setting tool according to claim 2, wherein the snap-in element (12) is a one arm rocking lever.

5. Setting tool according to claim 4, wherein the rocking lever comprises a control curve (12*d*) extending generally in the setting direction and cooperating with a control cam (8*d*) for disengagement from the housing.

6. Setting tool according to claim 2, wherein the snap-in element (12) is disengageable against the force of a return spring (13).

* * * * *